US010124934B2

(12) United States Patent
Zeng et al.

(10) Patent No.: US 10,124,934 B2
(45) Date of Patent: Nov. 13, 2018

(54) ANTI-COUNTERFEIT BOTTLE CAP

(71) Applicants: Quanzhou Huashuo Industry Co. Ltd, Fujian (CN); Shanghai Jiaheng Daily Chemical Co., Ltd., Shanghai (CN); Huanbin Zeng, Fujian (CN)

(72) Inventors: Huanbin Zeng, Fujian (CN); Congyan Xu, Fujian (CN); Rong Lin, Fujian (CN); Mingquan Cheng, Fujian (CN); Peiji Lin, Fujian (CN)

(73) Assignees: Jahen Household Products Co., Ltd., Fujian (CN); Shanghai Jiaheng Daily Chemical Co., Ltd., Shanghai (CN)

( * ) Notice: Subject to any disclaimer, the term of this patent is extended or adjusted under 35 U.S.C. 154(b) by 209 days.

(21) Appl. No.: 15/124,038

(22) PCT Filed: Sep. 17, 2015

(86) PCT No.: PCT/CN2015/089850
§ 371 (c)(1),
(2) Date: Sep. 7, 2016

(87) PCT Pub. No.: WO2017/020404
PCT Pub. Date: Feb. 9, 2017

(65) Prior Publication Data

US 2018/0162605 A1 Jun. 14, 2018

(30) Foreign Application Priority Data

Aug. 4, 2015 (CN) ..... 2015 1 0470637

(51) Int. Cl.
*B65D 41/04* (2006.01)
*B65D 41/34* (2006.01)
*B65D 41/32* (2006.01)

(52) U.S. Cl.
CPC ..... *B65D 41/3428* (2013.01); *B65D 41/04* (2013.01); *B65D 41/32* (2013.01); *B65D 41/3447* (2013.01)

(58) Field of Classification Search
CPC ..... B65D 41/32; B65D 41/04
USPC ..... 215/252
See application file for complete search history.

(56) References Cited

U.S. PATENT DOCUMENTS 5,360,126 A * 11/1994 Snyder ..... B65D 41/3447 215/252

* cited by examiner

*Primary Examiner* — James N Smalley
(74) *Attorney, Agent, or Firm* — Prakash Nama; Global IP Services, PLLC

(57) ABSTRACT

An anti-counterfeit bottle cap, having a body (10) and a safety ring bell (20), and a slit (30) in between; an anti-theft mechanism (40) is provided within the slit (30); the anti-theft mechanism (40) has upper rods (41), lower rods (43) and a tear ring (42) in between; upper ends of the upper rods (41) are connected to the body (10), lower ends of which are connected to the tear ring (42); upper ends of the lower rods (43) are connected with the tear ring (42), lower ends of which are connected with the safety ring belt (20). The tear ring is subject to irreversible plastic deformation after the body (10) disengages from the bottle mouth. Therefore, the tear ring (42) cannot be restored. The torn and broken upper rods (41), lower rods (43) or tear ring (42) cannot be glued back to its/their original position(s).

5 Claims, 5 Drawing Sheets

ANTI-COUNTERFEIT BOTTLE CAP

BACKGROUND OF THE INVENTION

The present invention relates to the technical field of bottle cap, and more specifically relates to a kind of anti-counterfeit bottle cap.

In daily lives and in industrial applications, plastic bottles are widely used because of their convenience and lightness, their resistance against corrosion and their low costs etc. Bottle caps fitted on the plastic bottles are mainly used for sealing the plastic bottles. Bottle caps now available in the market have various structures. CN203975494U discloses an anti-theft PE bottle cap comprising an upper cap, a lower cap arranged at the bottom of the inner cavity of the upper cap; a half surrounding safety ring is arranged on the periphery of the middle part of the sidewall of the upper cap; sidewall projecting tear ends are connected to the two ends of the safety ring respectively. During use, when the safety ring is torn, the upper cap can be opened with respect to the lower cap. When the safety ring is not yet torn, mouth of the bottle cannot be opened and accessed because the safety ring connects the upper cap and the lower cap together. Therefore, the liquid inside the bottle cannot be exchanged or stolen without damaging the entire bottle cap.

CN201144929 discloses an anti-counterfeit beverage bottle cap comprising a bottle cap and an anti-counterfeit breaking ring. The bottle cap is fixedly connected with the breaking ring via connecting rods; a locating device is provided on the breaking ring; the locating device cooperates with a stop ring positioned at the bottle mouth; the bottle cap and the bottle mouth are fitted together by screw threads. During use, the connecting rods are torn and broken due to rotation of the bottle cap; continual rotation of the bottle cap can detach the bottle cap from the bottle.

CN104386348A discloses an anti-impact and anti-theft bottle cap comprising a bottle cap body provided, with internal threads and a safety ring belt injection molded in one piece with the bottle cap body; a ring kerf is arranged between the bottle cap body and the safety ring belt, the ring kerf is provided with a plurality of connecting bridges at equal intervals connecting the bottle cap body and the safety ring belt; the bottle cap also comprises an annular anti-theft skirt injection, molded in one piece with the bottle cap body and the safety ring belt; the annular anti-theft skirt is connected with the edge of the safety ring belt and is capable to be flipped with respect to the edge of the safety ring belt; the anti-theft skirt form an annular flange around an inner side of the safety ring belt, the flange and the safety ring belt are connected in a way that an obtuse angle is formed between them; an inner ring of the annular anti-theft skirt is proximal to the center line of the bottle cap, and an outer ring of the annular anti-theft skirt is connected with the safety ring belt; wedge-shaped lugs which are uniformly distributed are formed on a surface of the annular anti-theft skirt facing away from an inner cavity of the bottle cap; a thin-wall part is formed between every two adjacent wedge-shaped lugs, and the wedge-shaped lugs are of a wedge-shaped lug structure; a high end of the lug structure is proximal to the inner ring of the annular anti-theft skirt, and a low end of the wedge-shaped lug structure is proximal to the outer ring of the annular anti-theft skirt.

The bottle caps described above have the following disadvantages: after the bottle caps are opened in a normal manner (after the bottle caps are opened, the safety ring belts are torn and the connecting rods/bridges are torn and broken), the liquid inside the bottles can be stolen or replaced by other substances. After that, super glue is used to position the safety ring belts or the connecting rods/bridges back to their original places, so that the bottle caps are restored back to their original appearances. Without careful inspection, general consumers are unable to determine whether the bottle caps have been opened before. Therefore, consumers' interests are adversely affected.

After thorough study of the above mentioned problems, the inventor has invented the present invention.

BRIEF SUMMARY OF THE INVENTION

An object of the present invention is to provide a bottle cap which is an anti-counterfeit bottle cap that cannot restore its original appearance after being opened. The bottle cap has the advantages of simple structure and low manufacturing costs.

To fulfill the above object, the present invention has the following technical scheme:

An anti-counterfeit bottle cap comprising a bottle cap body having internal screw threads and a safety ring belt injection molded with the bottle cap body to form a one whole piece with the bottle cap body; an annular slit is positioned between the safety ring belt and the bottle cap body; an anti-theft mechanism connecting the bottle cap body and the safety ring belt is provided within the annular slit; the anti-theft mechanism comprises a plurality of upper connecting rods, a plurality of lower connecting rods, and a tear ring provided between the upper connecting rods and the lower connecting rods; upper ends of the upper connecting rods are connected with the bottle cap body; lower ends of the upper connecting rods are connected with the tear ring; upper ends of the lower connecting rods are connected with the tear ring, lower ends of the lower connecting rods are connected with the safety ring belt; when rotation of the bottle cap body causes the bottle cap body to displace towards a direction away from the safety ring belt, the safety ring belt will be deformed; when the bottle cap body displaces to a predetermined position, the upper connecting rods or the lower connecting rods or the tear ring is/are torn and broken, and the safety ring belt and the bottle cap body will be mutually separated.

Preferably, the tear ring comprises a plurality of convex portions at an upper end thereof; the convex portions are mutually spaced with respect to one another; a sinking portion is provided between every two consecutive convex portions; the tear ring also comprises a plurality of concave portions at a lower end thereof; the concave portions are mutually spaced with respect to one another; a floating portion is provided between every two consecutive concave portions; the convex portions are positioned corresponding to the floating portions; the concave portions are positioned corresponding to the sinking portions; the upper connecting rods are provided between the convex portions and the bottle cap body; the lower connecting rods are provided between the concave portions and the safety ring belt; the upper connecting rods and the lower connecting rods are positioned in a staggered manner.

Preferably, the bottle cap body and the safety ring belt are injection molded as a one whole piece by using PE plastic materials.

Preferably, the tear ring has a thickness from 0.1 mm to 10 mm; a cross section of each of the upper connecting rods and a cross section of each of the lower connecting rods are both in a rectangular shape; a width of the rectangular shape is from 0.1 mm to 10 mm, a length of the rectangular shape is from 0.1 mm to 10 mm; both a thickness of each of the upper connecting rods and a thickness of each of the lower connecting rods range from 0.1 mm to 10 mm.

Preferably, a number of the upper connecting rods provided is twelve, and a number of the lower connecting rods provided is also twelve; a lateral spacing between every two consecutive upper connecting rods is more than 0.1 mm; a lateral spacing between every two consecutive lower connecting rods is also more than 0.1 mm.

Preferably, the tear ring consists of a first tear ring and a second tear ring; the first tear ring and the second tear ring are connected with each other via intermediate connecting rods; the upper connecting rods are provided between the bottle cap body and the first tear ring; the lower connecting rods are provided between the safety ring belt and the second tear ring.

According to the technical solution of the present invention, the anti-theft mechanism is constituted by the upper connecting rods, the tear ring and the lower connecting rods. When the bottle cap is mounted on the bottle mouth, user may rotate the bottle cap body such that the bottle cap body displaces upward gradually with the tear ring also deforms gradually. When the bottle cap body has displaced a certain distance one of the upper connecting rods, the lower connecting rods and the tear ring is/are torn and broken such that the safety ring belt is separated from the bottle cap body. According to this structure, the tear ring is subject to irreversible plastic deformation after the bottle cap body disengages from the bottle mouth. Therefore, the tear ring cannot be restored. The torn and broken upper connecting rods, lower connecting rods or tear ring cannot be glued back to its/their original position(s). Accordingly, the present invention prevents reconstruction of the anti-theft mechanism after the liquid inside the bottle is being stolen or replaced. Also, after injection molding of the bottle cap is finished, a bottle cap openings cutting machine can be used to directly form the anti-theft mechanism. Therefore, the present invention has the advantages of low manufacturing costs and simple structure.

DETAILED DESCRIPTION OF THE INVENTION

Figure 1:
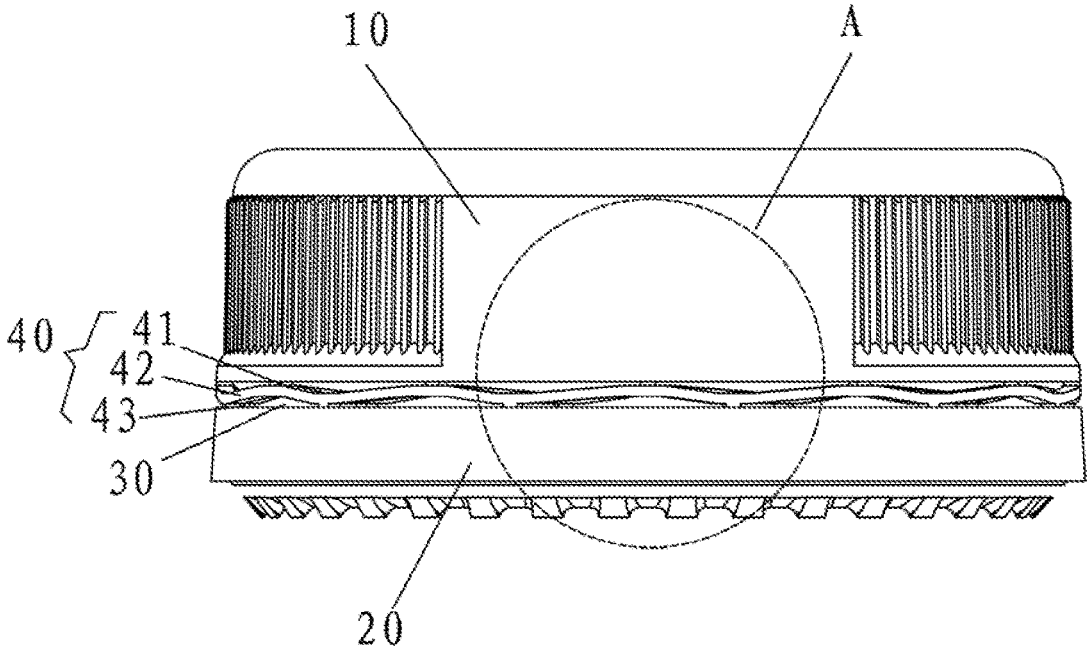
FIG. 1 is a schematic structural view of the present invention.
Figure 2:
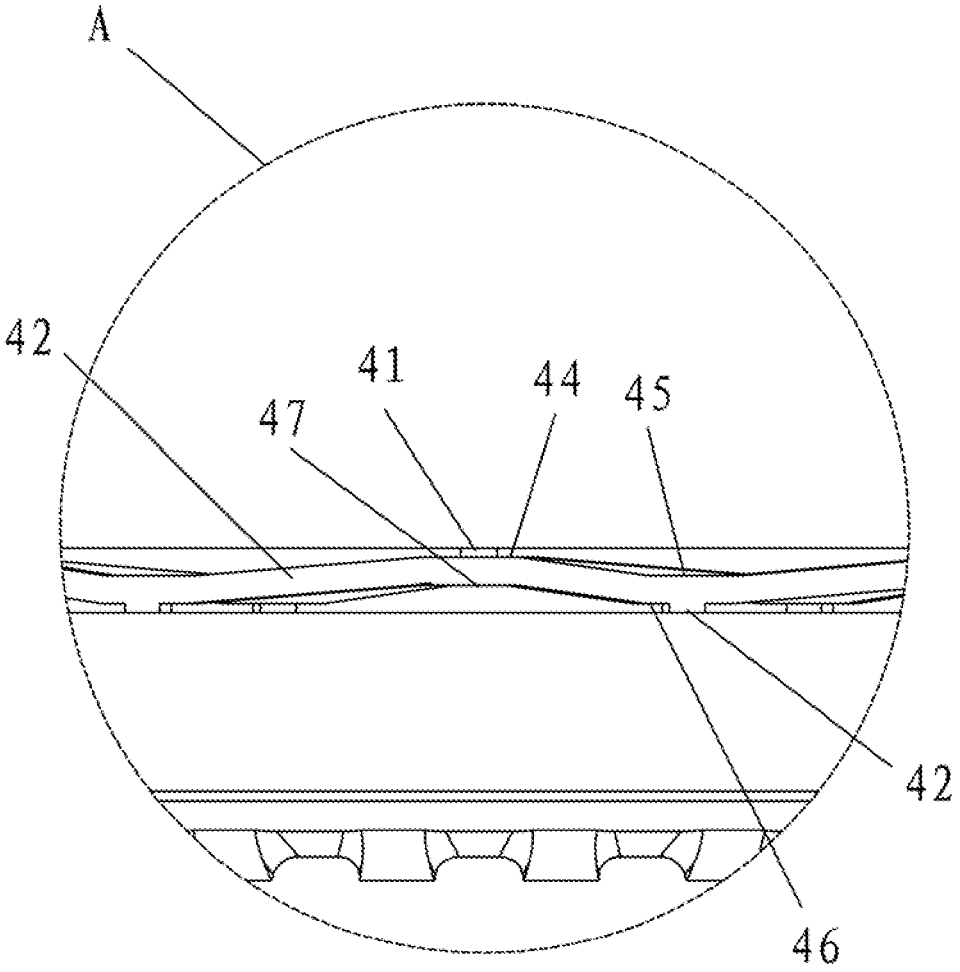
FIG. 2 is an enlarged view of portion A shown in FIG. 1.

With reference to FIGS. 1-6, an anti-counterfeit bottle cap comprises a bottle cap body 10 having internal screw threads and a safety ring belt 20 injection molded with the bottle cap body 10 to form a one whole piece with the bottle cap body 10; an annular slit 30 is positioned between the safety ring belt 20 and the bottle cap body 10 An anti-theft mechanism 40 connecting the bottle cap body 10 and the safety ring belt 20 is provided within the annular slit 30. When the bottle cap is mounted onto a bottle mouth, the safety ring belt 20 is fixed with a position limiting mechanism on the bottle mouth so as to be fixed and positioned. Connection structure between the safety ring belt 20 and the bottle mouth is known in the prior arts, for example in the prior arts discussed in the background section, and therefore will not be described in detail herein.

The main features of the present invention are described as follows: The anti-theft mechanism 40 comprises a plurality of upper connecting rods 41, a plurality of lower connecting rods 43, and a tear ring 42 provided between the upper connecting rods 41 and the lower connecting rods 43. Upper ends of the upper connecting rods 41 are connected with the bottle cap body 10; lower ends of the upper connecting rods are connected with an upper end of the tear ring 42. Upper ends of the lower connecting rods 43 are connected with the tear ring 42; lower ends of the lower connecting rods 43 are connected with an upper end of the safety ring belt 20. According to the present invention, after injection molding of the bottle cap body 10 and the safety ring belt 20 is finished, the annular slit 30, the tear ring 42, the upper connecting rods 41 and the lower connecting rods 43 can be formed directly by annular cutting procedures using a bottle cap openings cutting machine. After the bottle cap is manufactured, rotation of the bottle cap body 10 will cause the bottle cap body 10 to displace towards a direction away from the safety ring belt 20; accordingly, the safety ring belt 20 will be gradually deformed; when the bottle cap body 10 displaces to a predetermined position which is a maximum damage tolerable position, the upper connecting rods 41 or the lower connecting rods 43 or the tear ring 42 will be torn and broken and so the safety ring belt 20 and the bottle cap body 10 will be mutually separated. According to the inventive concept of the present invention, a person skilled in t his field of art may determine what materials should be used for making the bottle cap and how strong each part of the bottle cap should be, so that when the bottle cap body 10 is rotated, the upper connecting rods 41 will be torn first, or the lower connecting rods 43 will be torn first, or the tear ring 42 will be torn. Besides, the maximum damage tolerable position of the bottle cap body 10 is also associated with the choice of materials and relevant designs, therefore the present invention will not specifically limit the maximum damage tolerable position to a particular position.

Preferably, the tear ring 42 comprises a plurality of convex portions 44 at an upper end thereof; the convex portions 44 are mutually spaced with respect to one another. A sinking portion 45 is provided between every two consecutive convex portions 44. The tear ring 42 also comprises a plurality of concave portions 46 at a lower end thereof; the concave portions 46 are mutually spaced with respect to one another; a floating portion 47 is provided between every two consecutive concave portions 46; the convex portions 44 are positioned corresponding to the floating portions 47; the concave portions are positioned corresponding to the sinking portions 45; the upper connecting rods 41 are provided between the convex portions 44 and the bottle cap body 10; the lower connecting rods 43 are provided between the concave portions 46 and the safety ring belt 20; the upper connecting rods 41 and the lower connecting rods are positioned in a staggered manner. By using this structure, an upper end surface and a lower end surface of the tear ring 42 are both in a wavy shape. In addition to this, the upper connecting rods 41 and the lower connecting rods 43 are skillfully designed. As a result, the present invention saves much effort involved in rotating the bottle cap body 10. The bottle cap can be easily opened while the anti-theft mechanism 40 can be effectively damaged.

Preferably, the bottle cap body 10 and the safety ring belt 20 are injection molded as a one whole piece by using PE plastic materials. The tear ring 42 has a thickness from 0.1 mm to 10 mm. A cross section of each of the upper connecting rods 41 and a cross section of each of the lower connecting rods 43 are both in a rectangular shape. A width of this rectangular shape is from 0.1 mm to 10 mm, a length of this rectangular shape is from 0.1 mm to 10 mm. Both a thickness of each of the upper connecting rods and a thickness of each of the lower connecting rods range from 0.1 mm to 10 mm. Preferably, a number of the upper connecting rods 41 provided is twelve, and a number of the lower connecting rods 43 provided is also twelve. A lateral pacing between every two consecutive upper connecting rods 41 is more than 0.1 mm; a lateral spacing between every two consecutive lower connecting rods 43 is also more than 0.1 mm. By using this structure, connecting strength between the bottle cap body 10 and the safety ring belt 20 is taken into account, while the bottle cap body 10 can be ensured to effectively break away from the safety ring belt 20 when it is rotated to the maximum damage tolerable position. Effort of opening the bottle cap can also be saved.

Figure 3:
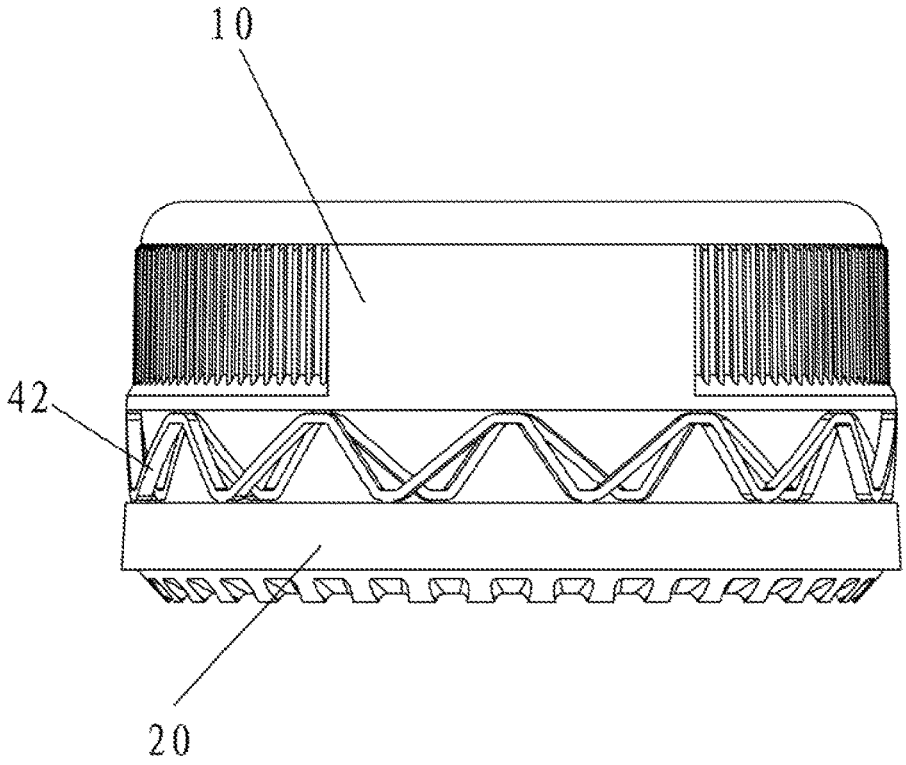
FIG. 3 shows a use condition of the present invention (the bottle cap body displaced away from the safety ring belt but yet to be broken away from the safety ring belt).
Figure 4:
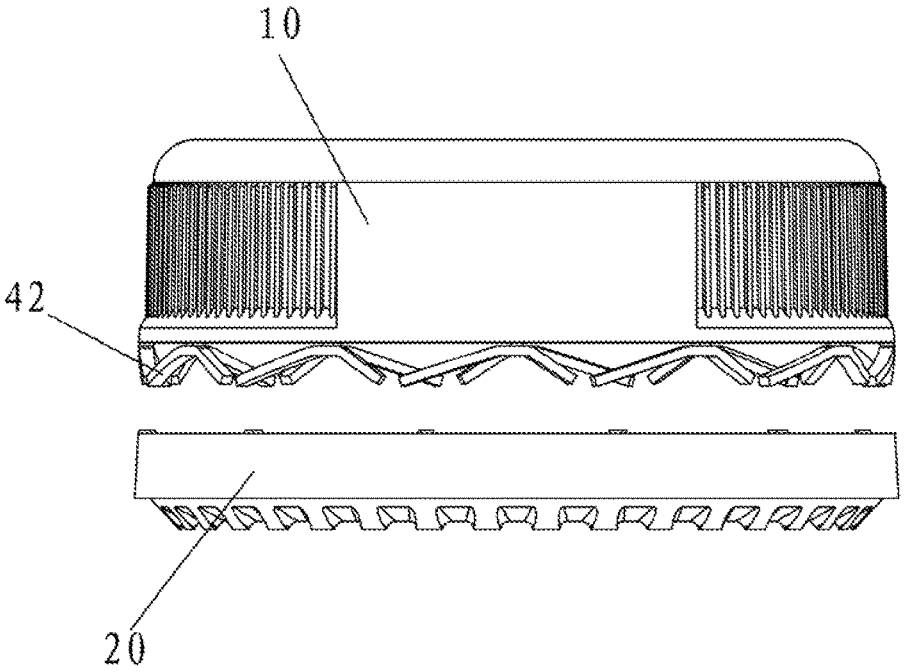
FIG. 4 shows another use condition of the present invention(the bottle cap body is broken away from the safety ring belt).
Figure 5:
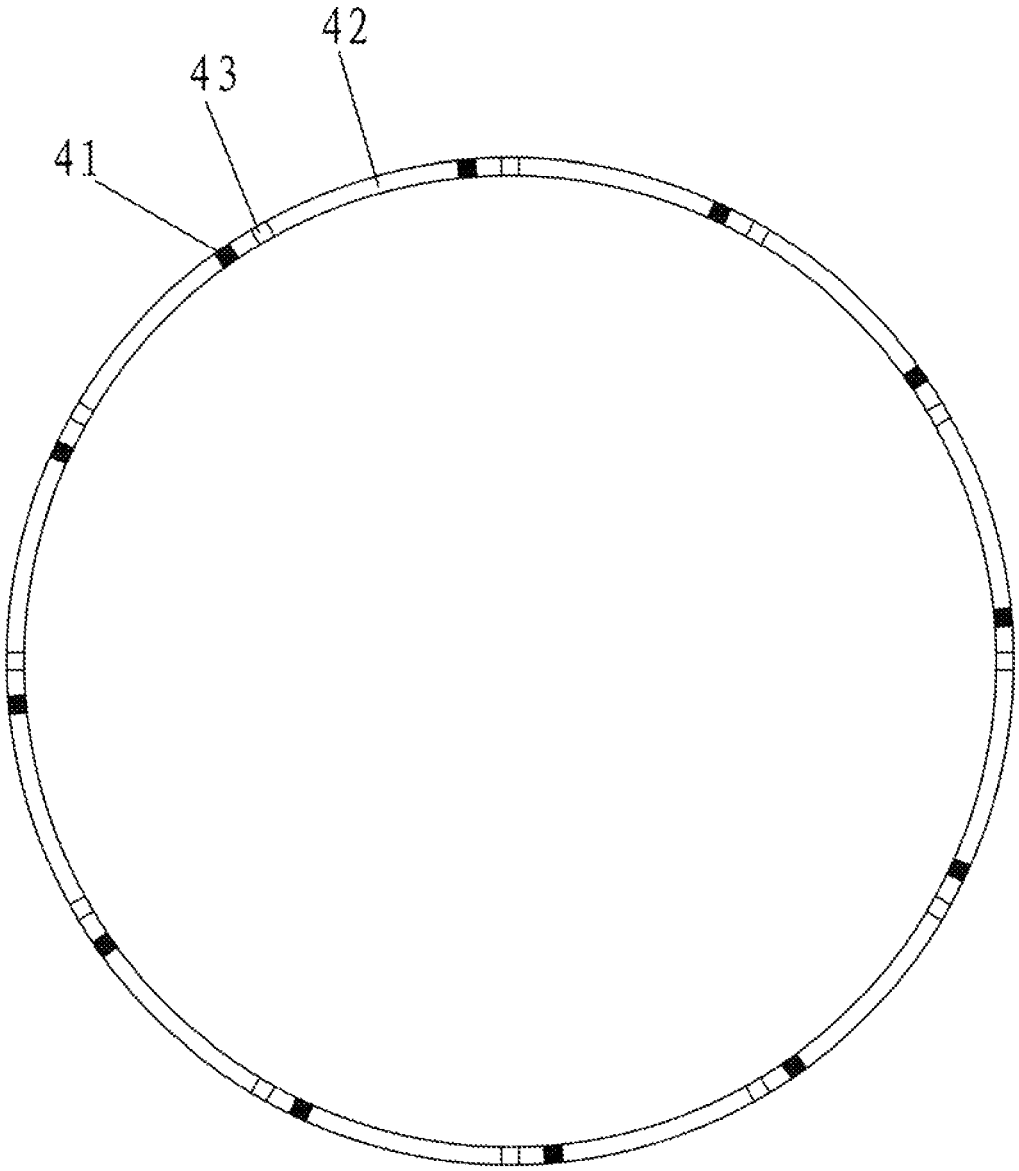
FIG. 5 is a top plan view of the tear ring of the present invention.

Reference is now made to FIGS. 3-4. FIG. 3 shows the bottle cap body 10 displaced away from the safety ring belt 20 but yet to be broken away from the safety ring belt 20. In this condition, the tear ring 42 is tensioned. In FIG. 4, the bottle cap body 10 is broken away from the safety ring belt 20. In this condition, the bottle cap body 10 can be easily disengaged from the bottle mouth by continual rotation of the bottle cap body 10 to achieve opening of the bottle cap.

Figure 6:
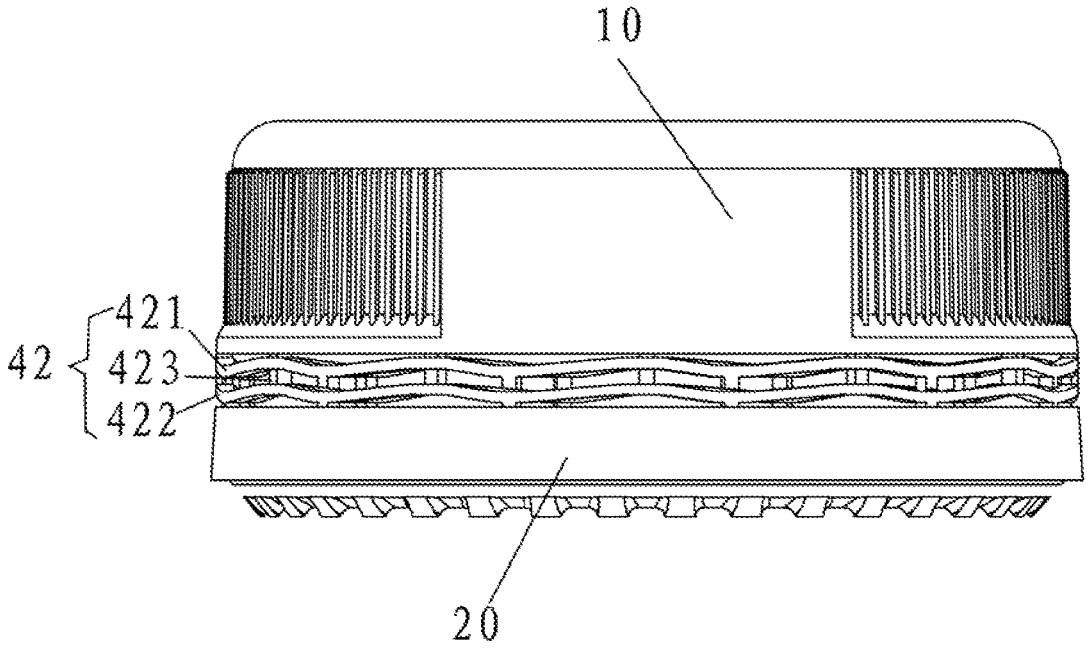
FIG. 6 is a schematic structural view of the present invention according to another embodiment.

Obviously the bottle cap of the present invention is not only limited to have only one tear ring 42. FIG. 6 shows a modified embodiment wherein the tear ring 42 consists of a first tear ring 421 and a second tear ring 422. The first tear ring 421 and the second tear ring 422 are connected with each other via intermediate connecting rods 423. The upper connecting rods 41 are provided between the bottle cap body 10 and the first tear ring 421. The lower connecting rods 43 are provided between the safety ring belt 20 and the second tear ring 422. Such a structure is essentially equivalent to using two tear rings. A person skilled in this field of art may alternatively provide three or more tear rings according to practice situation. All the tear rings are directly formed by using bottle cap openings cutting machine.

What is claimed is:

1. An anti-counterfeit bottle cap, comprising a bottle cap body having internal screw threads and a safety ring belt injection molded with the bottle cap body to form a one whole piece with the bottle cap body; an annular slit is positioned between the safety ring belt and the bottle cap body; an anti-theft mechanism connecting the bottle cap body and the safety ring belt is provided within the annular slit; wherein the anti-theft mechanism comprises a plurality of upper connecting rods, a plurality of lower connecting rods, and a tear ring provided between the upper connecting rods and the lower connecting rods; upper ends of the upper connecting rods are connected with the bottle cap body; lower ends of the upper connecting rods are connected with the tear ring; upper ends of the lower connecting rods are connected with the tear ring, lower ends of the lower connecting rods are connected with the safety ring belt; when rotation of the bottle cap body causes the bottle cap body to displace towards a direction, away from the safety ring belt, the safety ring belt is deformed; when the bottle cap body displaces to a predetermined position, the upper connecting rods or the lower connecting rods or the tear ring is/are torn and broken, and the safety ring belt and the bottle cap body are mutually separated; the tear ring consists of a first tear ring and a second tear ring; the first tear ring and the second tear ring are connected with each other via intermediate connecting rods; the upper connecting rods are provided between the bottle cap body and the first tear ring; the lower connecting rods are provided between the safety ring belt and the second tear ring.

2. The anti-counterfeit bottle cap according to claim 1, wherein the tear ring comprises a plurality of convex portions at an upper end thereof; the convex portions are mutually spaced with respect to one another; a sinking portion is provided between every two consecutive convex portions; the tear ring also composes a plurality of concave portions at a lower end thereof; the concave portions are mutually spaced with respect to one another; a floating portion is provided between every two consecutive concave portions; the convex portions are positioned corresponding to the floating portions; the concave portions are positioned corresponding to the sinking portions; the upper connecting rods are provided between the convex portions and the bottle cap body; the lower connecting rods are provided between the concave portions and the safety ring belt; the upper connecting rods and the lower connecting rods are positioned in a staggered manner.

3. The anti-counterfeit bottle cap according to claim 2, wherein the bottle cap body and the safety ring belt are injection molded as a one whole piece by using PE plastic materials.

4. The anti-counterfeit bottle cap according to claim 3, wherein the tear ring has a thickness from 0.1 mm to 10 mm; a cross section of each of the upper connecting rods and a cross section of each of the lower connecting rods are both in a rectangular shape; a width of the rectangular shape is from 0.1 mm to 10 mm; a length of the <rectangular shape is from 0.1 mm to 10 mm; both a thickness of each of the upper connecting rods and a thickness of each of the lower connecting rods range from 0.1 mm to 10 mm.

5. The anti-counterfeit bottle cap according to claim 4, wherein a number of the upper connecting rods is twelve, and a number of the lower connecting rods is also twelve; a lateral spacing between every two consecutive upper connecting rods is more than 0.1 mm; a lateral spacing between every two consecutive lower connecting rods is also more than 0.1 mm.

* * * * *